US008561422B2

(12) United States Patent
Jackman

(10) Patent No.: US 8,561,422 B2
(45) Date of Patent: Oct. 22, 2013

(54) PORTABLE CANNED DRINK COOLER AND DISPENSER

(76) Inventor: Wayne Jackman, Orlando, FL (US)

( * ) Notice: Subject to any disclaimer, the term of this patent is extended or adjusted under 35 U.S.C. 154(b) by 1337 days.

(21) Appl. No.: 11/829,169

(22) Filed: Jul. 27, 2007

(65) Prior Publication Data

US 2008/0034782 A1 Feb. 14, 2008

Related U.S. Application Data

(60) Provisional application No. 60/821,966, filed on Aug. 10, 2006.

(51) Int. Cl.
*F25D 3/08* (2006.01)

(52) U.S. Cl.
USPC ..... 62/457.4; 62/457.5; 62/457.2; 62/457.3

(58) Field of Classification Search
USPC ..... 62/457.2–457.5
See application file for complete search history.

(56) References Cited

U.S. PATENT DOCUMENTS

| | | | | |
|---|---|---|---|---|
| 3,717,282 | A * | 2/1973 | Nordskog | 221/279 |
| 4,324,111 | A * | 4/1982 | Edwards | 62/457.4 |
| 4,899,904 | A | 2/1990 | Dooley et al. | |
| 4,910,977 | A * | 3/1990 | Hilton | 62/457.5 |
| 5,269,156 | A | 12/1993 | van de Velde et al. | |
| 5,272,890 | A * | 12/1993 | Penxa | 62/457.4 |
| 5,413,414 | A * | 5/1995 | Bauer | 384/276 |
| 5,509,279 | A | 4/1996 | Brown et al. | |
| 6,065,303 | A | 5/2000 | Harris | |
| 6,360,558 | B1 | 3/2002 | Woog | |
| 6,598,419 | B1 | 7/2003 | Tago | |
| 6,862,896 | B1 | 3/2005 | Seidl | |
| 6,925,834 | B2 | 8/2005 | Fuchs | |
| 7,100,397 | B1 * | 9/2006 | Gratteau | 62/457.5 |
| 2005/0087538 | A1 * | 4/2005 | Wolfe et al. | 220/592.16 |
| 2006/0000229 | A1 * | 1/2006 | D'Angelo | 62/246 |

* cited by examiner

*Primary Examiner* — Cheryl J Tyler
(74) *Attorney, Agent, or Firm* — Beusse Wolter Sanks Mora & Maire, P.A.; Erica M. Cipparone; John V. Stewart

(57) ABSTRACT

A tube (20) with outer and inner walls (22, 24) and webbing (26) between them. The inner wall (24) forms a cylindrical inner chamber (28) that slidably receives drink cans (50) end-to-end. Spaces between the inner and outer walls, and between the webbing, form longitudinal thermal chambers (23) surrounding the inner wall for receiving thermal packs (48) along the length of the inner chamber (28). Convection paths (32) between the thermal chambers (23) and the inner chamber (28) provide air circulation for efficient heat transfer. The inner chamber has an access opening (29) at the front end of the tube for receiving and dispensing the drink cans. An elevator (40) in the inner chamber may be provided to move drink cans toward the access opening via cords or rods (44) extending from the front end of the tube that pull the elevator toward the front end of the tube.

3 Claims, 4 Drawing Sheets

PORTABLE CANNED DRINK COOLER AND DISPENSER

This application claims benefit of the Aug. 10, 2006, filing date of U.S. provisional application 60/821,966.

FIELD OF THE INVENTION

The invention relates to portable coolers for canned drinks as especially used for outdoor and travel applications.

BACKGROUND

Portable coolers are known in a variety of forms. Some of them have one or more compartments for canned drinks and a separate ice compartment that may also be a general-purpose compartment. See for example U.S. Pat. Nos. 5,269,156, 5,509,279, and 6,862,896. Others are specialized for drinks, including canned or bottled drinks. See for examples U.S. Pat. Nos. 4,899,904, 6,065,303, 6,360,558, and 6,598,419.

BRIEF DESCRIPTION OF THE DRAWINGS

The invention is explained in following description in view of the drawings that show.

DETAILED DESCRIPTION OF THE INVENTION

The present inventor invented and designed a portable canned drink cooler and dispenser that is more compact for a given can capacity than prior coolers, more efficient in cooling, convenient to use, and less expensive to produce.

Figure 1:
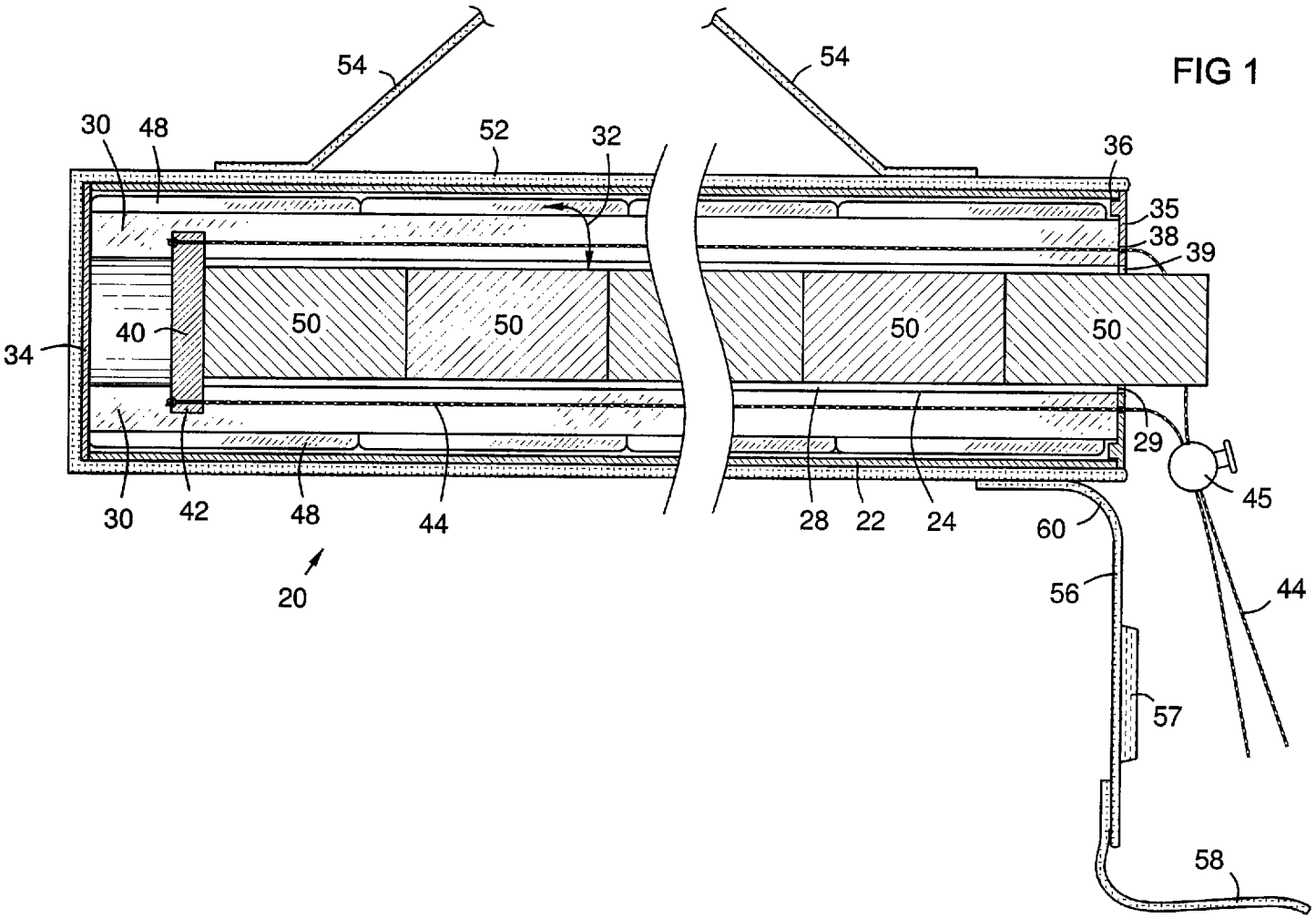
FIG. 1 is a side sectional view of a portable can cooler according to aspects of the invention.
Figure 2:
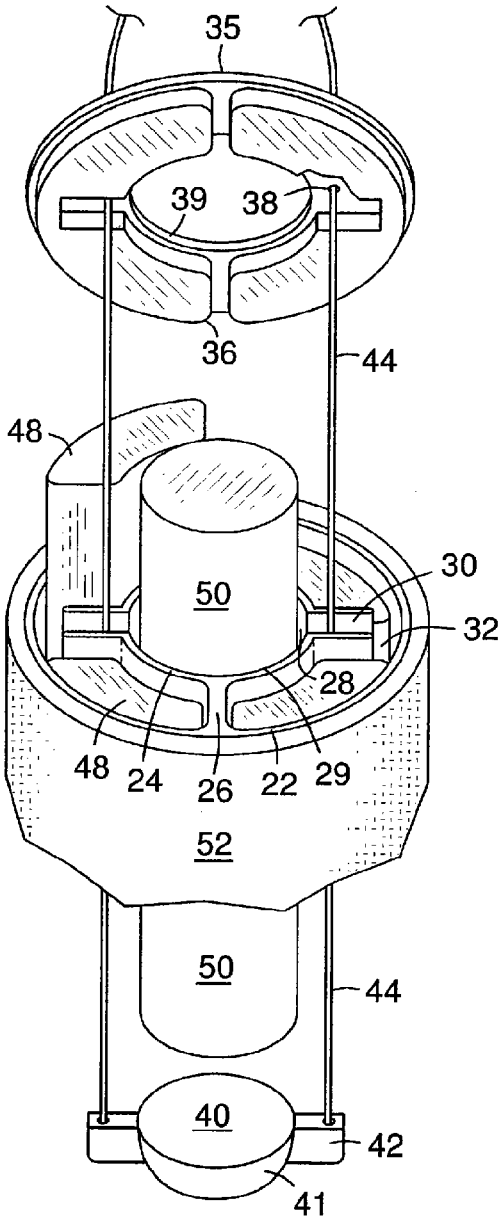
FIG. 2 is a partial perspective view of the front end of the can cooler of FIG. 1.
Figure 3:
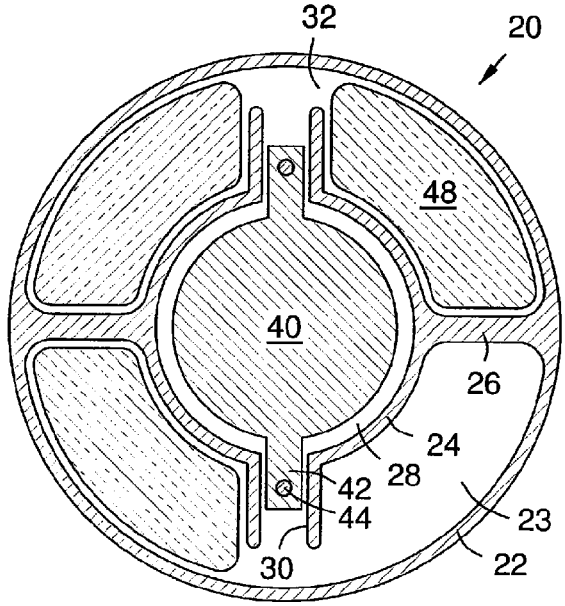
FIG. 3 is a front sectional view of the can cooler of FIG. 1.

FIGS. 1-3 show views of a portable canned drink cooler and dispenser according to aspects of the invention. A tube 20 is formed of an outer wall 22 and an inner wall 24 with connecting webbing 26 that is oriented longitudinally with respect to the tube (i.e. parallel to a longitudinal axis of the tube 20). This tube provides a generally cylindrical inner chamber 28 for holding drink cans 50 end-to-end. Cooling packs 48 are inserted in longitudinal thermal chambers 23 formed between the outer and inner walls 22, 24 of the tube 20 between the webbing 26. The cooling packs 48 may be gel packs as known for portable coolers or therapeutic icing applications. They may be kept in a freezer until needed for portable drink cooling. Convection communication paths 32 may be provided between the cooling packs 48 and the inner chamber 28 to facilitate heat transfer from the drink cans 50 to the cooling packs 48. The tube 20 of FIGS. 1-3 may be extruded or molded of plastic or other suitable material.

Figure 8:
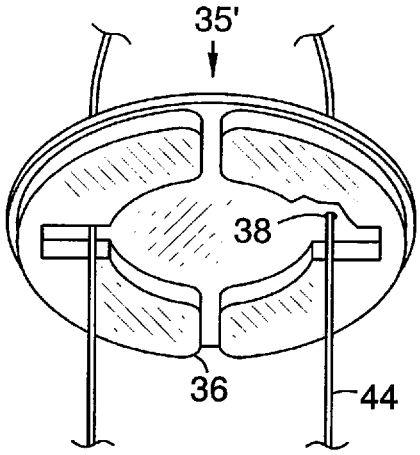
FIG. 8 shows a perspective view of an alternate front cap without a central hole.
Figure 9:
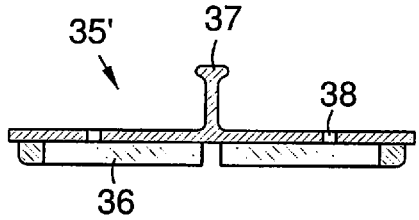
FIG. 9 shows a sectional view of the front cap of FIG. 8.

An elevator plate 40 may be slidably mounted in the inner chamber 28 by means of elevator tracks 30 formed in the inner wall 24 of the tube 20. Slide bars 42 on the elevator plate 40 engage these tracks 30 slidably. The tracks 30 and slide bars 42 may be diametrically opposed as shown. A cord 44 may be attached to each slide bar 42, and may pass through guide holes 38 in a front cap 35 of the tube 20. These cords 44 may be pulled from the front of the tube 20 to move the elevator 40, which slides the drink cans 50 toward the front access opening 29 of the inner chamber 28. The front cap 35 may have a central hole 39 with the same diameter as the inner chamber 28, so the cans 50 will extend out of the front cap 35 when the elevator cords 44 are pulled through the holes 38 in the front cap 35 as shown in FIG. 1. While it is recognized that the cans 50 may be moved into and out of the inner chamber 28 via gravity by tilting the tube 20 into an appropriate orientation, and thus some embodiments of the invention may not utilize any such elevator assembly, the embodiment of FIGS. 1-3 may be used to store and to retrieve cans without the necessity for rotation or tilting of the tube 20. The front cap 35 may be removable to allow insertion and removal of the cooling packs 48. It may have a back surface 36 formed in a pattern that mates with the front end of the tube walls and webbing 22, 24, and 26 in a slight interference fit, so that it structurally stabilizes the front end of the tube 20. A back cap 34 may permanently close and structurally stabilize the back end of the tube 20. The front cap 35 may alternately be provided without the central hole 39, and may have a grip 37 for easy removed to access the cans 50 as shown in FIGS. 8 and 9.

A releasable rope lock 45 may join and clamp the cords 44 together outside of the front cap 35. If desired, the cords 44 may be pulled through this rope lock as cans 50 are dispensed, to hold the remaining cans 50 closer to the front cap 38. Alternately, the cords 44 may be replaced with solid or hollow rods of any suitable material and any suitable cross-section such as a round cross-section, and the rope lock 45 may be replaced with a handle attached to the front ends of the rods.

A carrying cover 52 may enclose the tube 20. It may have a carrying strap or handle 54 and a front cover 56 on a flexible hinge 60. The front cover 56 may have an insulating plug 57 that fits the central hole 39 of the tube front cap 35, and may have a closure strap 58 with fastening means such as Velcro®.

Figure 4:
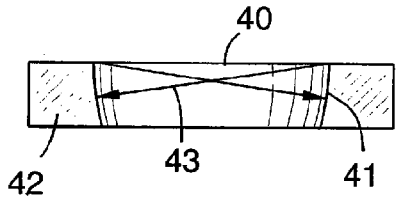
FIG. 4 is a side view of an elevator plate according to an aspect of the invention.

FIG. 2 shows a partial perspective view of the front end of the can cooler of FIGS. 1 and 3. The elevator 40 may be shaped as shown in FIGS. 2 and 4, with sides 41 curved as shown in FIG. 4 with a radius 43 that prevents binding of the elevator plate 40 in the inner chamber 28. The radius 43 may for example be centered near the diametrically opposite side of the elevator plate 40, so that no degree of canting of the plate 40 can cause binding.

Figure 5:
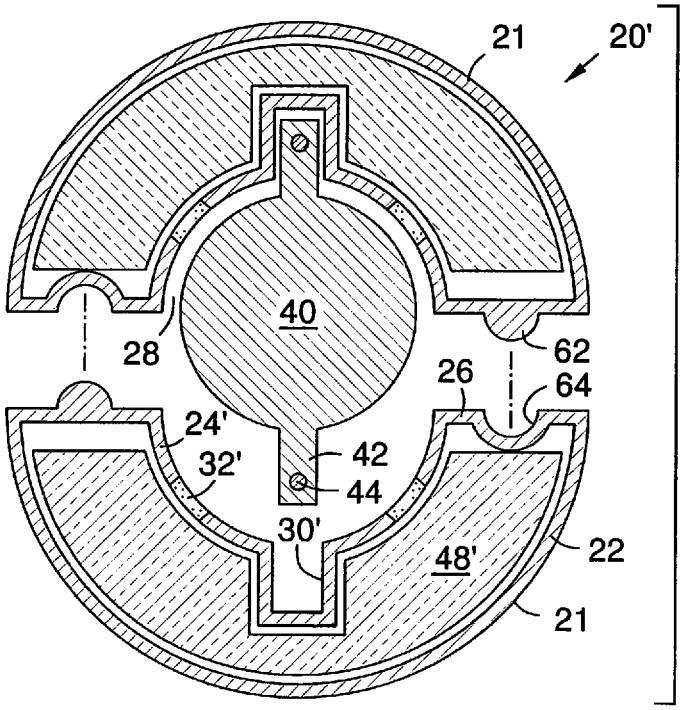
FIG. 5 is a front sectional view of an alternate embodiment of the tube.

FIG. 5 shows an alternate embodiment of the tube 20' formed from first and second identical halves 21 that can be molded or extruded, and then glued together. Coupling ridges 62 and grooves 64 may be provided to facilitate alignment during assembly. Convection communication may be provided by holes 32' in the inner walls 24'. Cooling packs 48' may be custom designed for this tube shape as shown.

Figure 6:
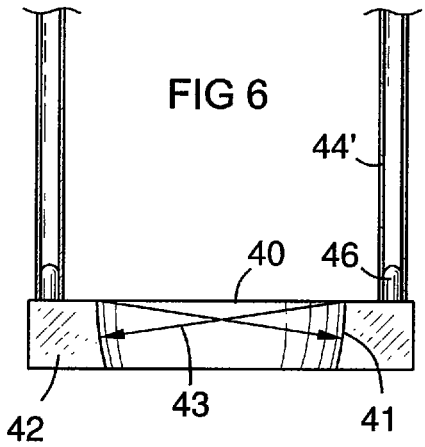
FIG. 6 shows hollow rods attached to the elevator instead of cords.
Figure 7:
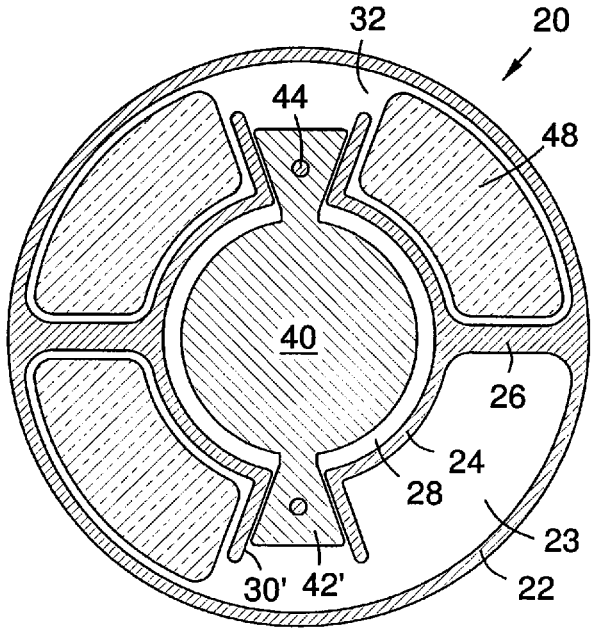
FIG. 7 shows an alternate geometry of the elevator tracks and slide bars.

FIG. 6 shows alternate hollow rods 44' attached to the elevator 40 for moving the elevator instead of cords 44. The rods 44' may be attached by engagement with, and gluing to, nipples 46 on the elevator, or by other known means. FIG. 7 shows an alternate geometry of the elevator tracks 30' and slide bars 42'. Trapezoidal slide bars 42', engage V-shaped tracks 30' to prevent the elevator 40 from shifting diagonally and contacting the inner wall 24. In general this track and slide geometry can be described as the slide bars 42' increasing in circumferential extent with radial distance from the elevator, and the tracks 30' matching the slide bars 42'. For example, the slide bars may be T-shaped instead of trapezoidal within this general description. FIGS. 8 and 9 show an alternate embodiment of the front cap 35' with a grip 37 and without a central hole. The cans 50 are accessed by removing the cap 35'.

The tube 20 of the cooler, including the outer wall 22, the inner wall 24, the webbing 26, the longitudinal thermal chambers 23, and the elevator tracks 30, may be formed of a single extrusion of a material such as polyvinylchloride for example. This is a very inexpensive manufacturing process, with no assembly needed for the tube parts. Alternately, the tube 20' of FIG. 5 may be formed of two substantially identical extrusions with mating shapes as previously described.

This portable canned drink cooler and dispenser provides a compact carrying form that easily fits in narrow spaces, such as the floor of a car behind the front seats. It provides efficient cooling because the coolant 48 closely and evenly surrounds each can 50, has convective as well as conductive heat transfer. Convenient can dispensing may be provided via the elevator device 40.

While various embodiments of the present invention have been shown and described herein, it will be obvious that such embodiments are provided by way of example only. Numerous variations, changes and substitutions may be made without departing from the invention herein. Accordingly, it is intended that the invention be limited only by the spirit and scope of the appended claims.

The invention claimed is:

1. A portable canned drink cooler and dispenser, comprising:

a tube comprising an outer wall and an inner wall with a webbing between the walls connecting the walls, the inner wall forming a generally cylindrical inner chamber comprising a length that slidably holds multiple drink cans end-to-end;

spaces between the inner and outer walls and between the webbing forming longitudinal thermal chambers surrounding the inner wall suitable for receiving thermal packs along the length of the inner chamber; and the inner chamber comprising an access opening at a front end of the tube for receiving and dispensing the drink cans endwise;

an elevator in the inner chamber for moving the drink cans toward the access opening, the elevator comprising an elevator plate slidably mounted in the inner chamber, and cords or rods attached to the elevator plate and extending from the front end of the tube that pull the elevator plate toward the front end of the tube to move the drink cans toward the access opening;

the elevator plate comprising diametrically opposed slide bars slidably engaged in longitudinal tracks formed in the inner wall, one of the cords or rods attached to each of the slide bars and extending from the front end of the tube for manually pulling the elevator toward the access opening via the cords or rods;

wherein the elevator plate comprises sides that converge toward each other and away from the inner wall with increasing distance behind a front surface of the elevator plate to prevent binding of the elevator plate against the inner wall;

wherein the sides of the elevator plate are formed as a surface of rotation with a sectional radius centered approximately at the diametrically opposite side of the elevator plate, wherein no degree of canting of the plate can cause binding of the plate in the inner chamber.

2. A portable canned drink cooler and dispenser, comprising:

a tube comprising an outer wall and an inner wall with a webbing between the walls connecting the walls, the inner wall forming a generally cylindrical inner chamber comprising a length that slidably holds multiple drink cans end-to-end;

spaces between the inner and outer walls and between the webbing forming longitudinal thermal chambers surrounding the inner wall suitable for receiving thermal packs along the length of the inner chamber;

the inner chamber comprising an access opening at a front end of the tube for receiving and dispensing the drink cans endwise;

an elevator in the inner chamber for moving the drink cans toward the access opening, the elevator comprising an elevator plate slidably mounted in the inner chamber, and cords or rods attached to the elevator plate and extending from the front end of the tube that pull the elevator plate toward the front end of the tube to move the drink cans toward the access opening;

the elevator plate comprising sides that converge toward each other and away from the inner wall with increasing distance behind a front surface of the elevator plate to prevent binding of the elevator plate against the inner wall;

the elevator plate further comprising diametrically opposed slide bars slidably engaged in longitudinal tracks formed in the inner wall, one of the cords or rods attached to each of the slide bars and extending from the front end of the tube to a grip for manually pulling the elevator toward the access opening via the cords or rods; and the webbing comprises two diametrically opposed webs between the inner and outer walls, and the elevator tracks comprise two diametrically opposed gaps in the inner wall, the gaps offset approximately 90 degrees from the diametrically opposed webs;

wherein the elevator tracks comprise track walls extending radially from edges of the track gaps part way outward toward the outer wall, leaving space for thermal convection paths between the track walls and the outer wall.

3. A portable canned drink cooler and dispenser, comprising:

a tube comprising a generally cylindrical outer wall, a concentric generally cylindrical inner wall, and webbing connecting the inner and outer walls, the inner wall forming a generally cylindrical inner chamber comprising a length for slidably receiving multiple drink cans end-to-end;

spaces between the inner and outer walls and between the webbing forming longitudinal thermal chambers surrounding the inner wall for receiving thermal packs along the length of the inner chamber;

convection communication paths between the thermal chambers and the inner chamber providing air circulation there between;

the inner chamber comprising an access opening at a front end of the tube for receiving and dispensing the drink cans endwise;

an elevator in the inner chamber for moving the drink cans toward the access opening, the elevator comprising an elevator plate slidably mounted in the inner chamber, and at least one cord or rod attached to the elevator plate and extending from the front end of the tube for pulling the elevator plate toward the front end of the tube to move the drink cans toward the access opening;

a back cap closing a back end of the tube; and a front cap removably covering the front end of the tube.

* * * * *